US005275289A

United States Patent [19]

Blatt

[11] Patent Number: 5,275,289

[45] Date of Patent: Jan. 4, 1994

[54] FRAME CONTAINER SUPPORT AND STACKABLE CONTAINER SYSTEM USING SAME

[75] Inventor: Raymond F. Blatt, Huntington Valley, Pa.

[73] Assignee: Pak-It Metal Display Corp., Bensalem, Pa.

[21] Appl. No.: 928,565

[22] Filed: Aug. 11, 1992

[51] Int. Cl.[5] ..... B65D 7/20

[52] U.S. Cl. ..... 206/513; 206/386; 220/495

[58] Field of Search ..... 206/509, 503, 401, 485, 206/493, 513, 386; 220/495, 494, 485

[56] References Cited

U.S. PATENT DOCUMENTS

| | | | |
|---|---|---|---|
| 1,936,164 | 11/1933 | Jarvis | 206/513 |
| 1,991,770 | 2/1935 | Pawsat | 206/513 |
| 2,807,454 | 9/1957 | Beadle | 206/509 |
| 2,838,198 | 6/1958 | Vidal | 206/509 |
| 2,988,313 | 6/1991 | Ellison | 206/513 |
| 3,202,295 | 8/1965 | Drader | 206/509 |
| 3,704,791 | 12/1972 | Young, Jr. | 206/509 |
| 3,717,259 | 2/1973 | Fried et al. | 206/509 |
| 3,784,044 | 1/1974 | Bruggeman et al. | 206/513 |
| 3,866,788 | 2/1975 | Smit | 206/513 |
| 4,150,762 | 4/1979 | Brunette . | |

*Primary Examiner*—Joseph Man-Fu Moy

*Attorney, Agent, or Firm*—Seidel, Gonda, Lavorgna & Monaco

[57] ABSTRACT

A frame container support is formed from a substantially planar rectangular section and a plurality of corner sections attached to the corners of the rectangular section. Each corner section has a container framing section extending a predetermined distance from one side of the rectangular section's plane and downwardly depending segments, which may be loop-shaped, extending a predetermined distance from the opposite side of the plane. The frame may also have a plurality of container support sections which join two adjacent sides of the rectangular peripheral portion. A container is supported within the frame. Plural frame container supports may be placed one on top of another to form a stack by fitting the downwardly depending segments snugly over the outside surface of the container framing segments of the frame disposed immediately below. Lateral movement of the frames with respect to each other is inhibited by this stacking technique. The downwardly depending segments of the lower-most frame may be braced against and/or slotted into a pallet, thereby permitting placement of the entire stack on the pallet. A shroud may be placed over the stack during shipping. The containers may be constructed of corrugated board with a relief portion formed in the corners of the container to inhibit buckling due to the weight of contents of containers above.

40 Claims, 7 Drawing Sheets

FRAME CONTAINER SUPPORT AND STACKABLE CONTAINER SYSTEM USING SAME

FIELD OF THE INVENTION

This invention relates to stackable container transport and display systems and more particularly to stacking systems which use a plurality of intermeshing frames which support the containers.

BACKGROUND OF THE INVENTION

Stackable containers which form vertically stable stacks are known in the art. However, stackable container systems wherein a frame supports a container, and wherein the frame includes a corner section that provides framing the container corners within the frame and which simultaneously provides bracing for the container below, are not known.

There is a need for a stackable container system and a container support that is easy to fabricate, inexpensive to manufacture, lightweight but strong, easily stackable to any desired height, quickly and easily set up and broken down, and which can be placed on a shipping pallet so that it will not shift laterally on the pallet as the pallet is moved during shipping and handling. The present invention fills these needs.

SUMMARY OF THE INVENTION

The present invention provides a frame for supporting a container. The frame comprises a substantially rectangular peripheral portion and corner members attached to at least two corners of the rectangular peripheral portion. Each of the corner members include a framing member extending a predetermined distance from one side of the plane and at least two projecting members extending a predetermined distance from the opposite side of the plane. At least one projecting member is disposed on adjacent sides of each of the corner members.

In one embodiment, the rectangular peripheral portion of the frame further includes at least one angular corner segment for joining two adjacent sides of the rectangular peripheral portion.

The invention also provides a stackable display system for stacking a plurality of containers one on top of another wherein each container is supported within a frame. The projecting members brace the frame below it by fitting over the outside of a framing member of the frame below, thereby inhibiting lateral movement of the frames with respect to each other. By this manner, a stable stack of container/rack combinations can be constructed.

The invention also provides an alternative embodiment of a stackable display system for stacking a plurality of containers one on top of another, wherein each container is supported within a frame. In this embodiment, the frame comprises a peripheral portion means for framing the outer edges of the frame. The peripheral portion means is substantially rectangular in shape and disposed in a plane. The frame further comprises a corner means for framing and bracing the containers and frames. The corner means includes a framing means for framing the corners of one of the plurality of containers supported within a frame and preventing lateral movement of the container within the frame. The framing means extends a predetermined distance from one side of the plane. The corner means also includes a projecting means for bracing the frame below it. The projecting means extends a predetermined distance from the opposite side of the plane and fits over the outside of a framing means of the frame below, thereby inhibiting lateral movement of the frames with respect to each other.

The present invention further presents a novel display system for shipping a plurality of containers supported by frames and placed one on top of another to form a stack. Once the stack is formed a shroud is placed over the entire stack to provide for a single shippable unit. In one embodiment of this shipping system, the protruding portion of the bottom-most container is braced against and/or slotted into a pallet, thereby permitting placement of the entire stack on a pallet.

The present invention further presents a stackable display system for providing container buckling relief for a plurality of frame-supported containers stacked one on top of each other. In this embodiment, the containers are constructed of corrugated board and a relief portion is formed in the corners of the container.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DESCRIPTION OF THE PREFERRED EMBODIMENT

Figure 1:
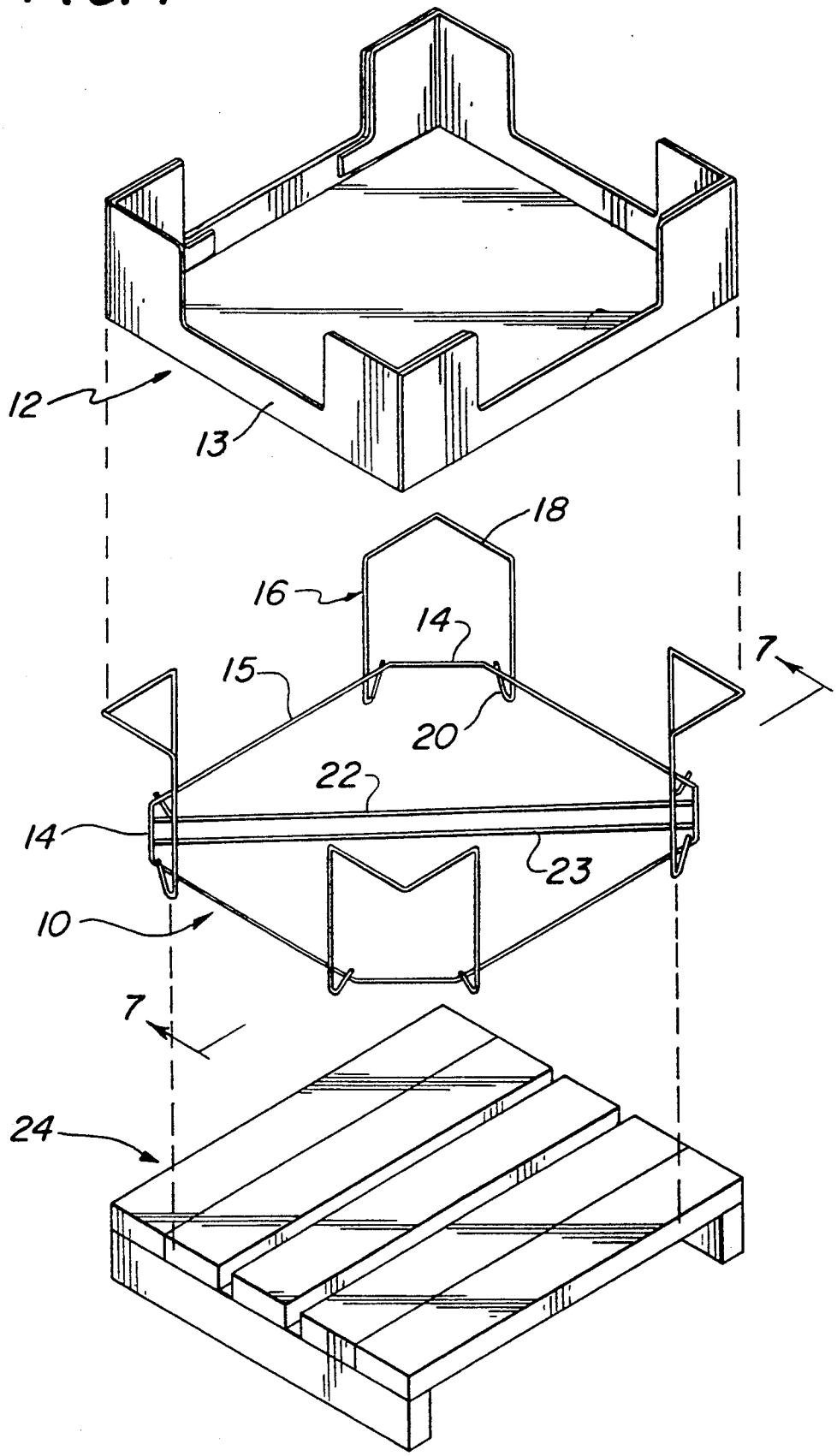
FIG. 1 is an exploded view of a frame, container and pallet, showing how the three elements fit together.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

Apparatus depicting the preferred embodiments of the novel frame container support and stackable container method using frame container supports are illustrated in the drawings.

Turning first to FIG. 1, a container 12 with sides 13 fits into and is supported by a frame 10. The frame 10 comprises a rectangular section 15 which includes a container support section 14. In the preferred embodiment, the container support section 14 is formed by truncated corners of the rectangular section 15. The container 12 may be further supported by optional cross ties 22 and 23 which are connected to diagonally opposite corners. The frame 10 also comprises corner sections 16, each of which include a container framing segment 18 and at least one downwardly depending segment 20. The container framing segment 18 extends upward perpendicular to the rectangular section 15 and forms a corner for framing the corner of the container 12. The frame 10 is designed to fit on top of a platform 24 or a like frame 10. The downwardly depending segments 20 fit snugly over and around the outside surface of the platform 24. In the preferred embodiment shown in FIG. 1, the platform 24 is a quarter pallet, which may also serve as a display platform.

Figure 2:
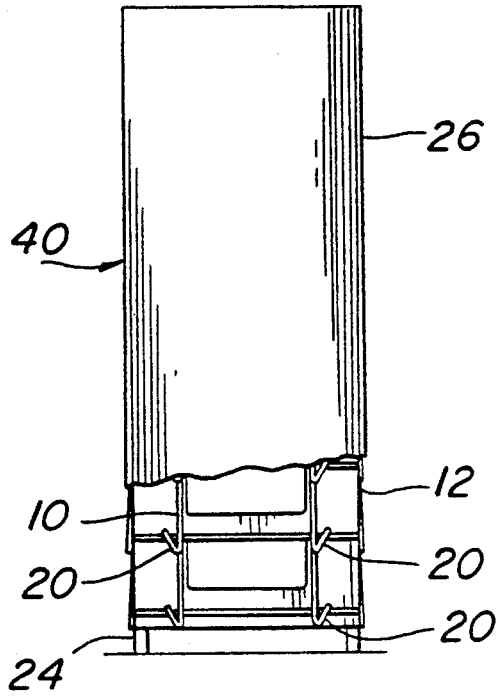
FIG. 2 is a side view of a stack of frame-supported containers partially covered by a shroud.

FIG. 2 shows a plurality of containers 12 fitted into a plurality of frames 10 and stacked one on top of another to form a stack 40. The stack 40 is disposed on platform 24. During shipping and/or storage, a shroud 26 is placed completely over the stack 40. The shroud 26 may consist of any material suitable for covering the stack 40. Preferably, it comprises a closed box of corrugated board which fits over stack 40. In this manner, disassembly at a point of sale consists of merely lifting the shroud 26 up and over the stack 40, thereby revealing the merchandise in the containers. Corrugated board is preferred for shroud 26, because it is effective in preventing pilfering of the contents of containers 12. Shrink wrapping can also be used for the shroud if security during shipping is not a concern, or if it is important to be able to view the contents of containers 12.

As also depicted in FIG. 2, the downwardly depending segments 20 on the bottom frame support stack 40 serve to prevent lateral shifting of stack 40 on platform 24. Downwardly depending segments 20 on the frame immediately above the bottom frame provide frame and container bracing for the frame and container stacked immediately below. This bracing inhibits lateral movement of the lower container held within the frame. The downwardly depending segment 20 also inhibits lateral movement of upper and lower sets of frames with respect to one another.

Figure 3:
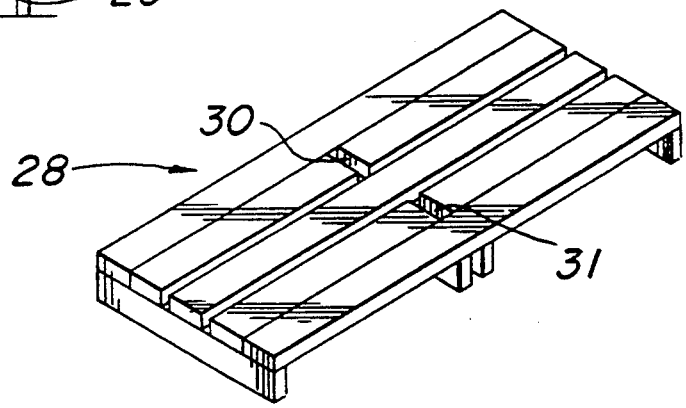
FIG. 3 is a view of a half pallet for holding two stacks of containers, showing channels for slotting frame projecting portions therein.
Figure 4:
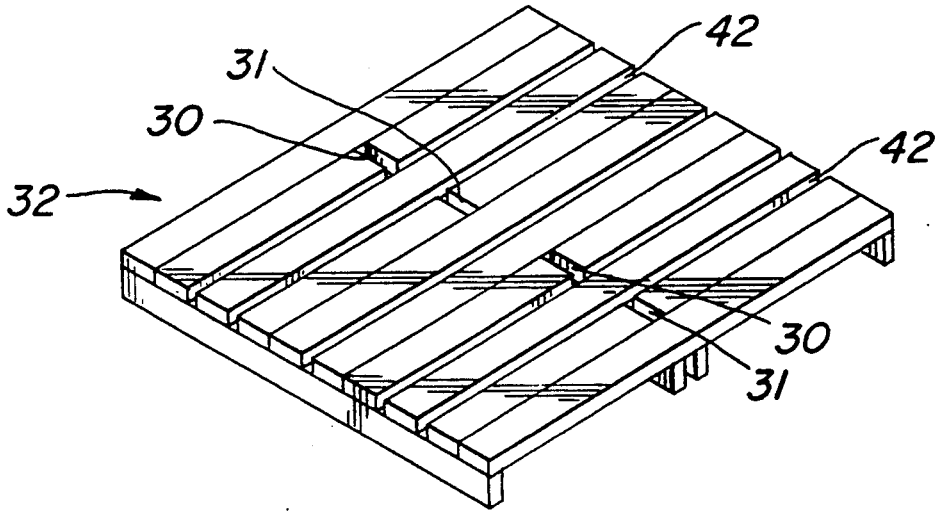
FIG. 4 is a view of a full pallet for holding four stacks of containers, showing channels for slotting frame portions therein.

FIGS. 3 and 4 shows other platform configurations which can receive and support a plurality of stacks 40. FIG. 3 shows a half pallet 28 with two channels 30 and 31. In this embodiment, six of the downwardly depending segments 20 of a bottom frame 10 fit snugly over and around the outside surface of the half pallet 28. The remaining two downwardly depending segments 20 fit into channels 30 and 31, respectively. The channel is wide enough for two downwardly depending segments 20. Thus, two stacks 40 may be placed adjacent one another on the half pallet 28. Likewise, FIG. 4 shows a full pallet 32 with plural sets of channels 30 and 31. In this embodiment, four downwardly depending segments 20 of a bottom frame 10 fit snugly over and around two adjacent outside surfaces of the full pallet 32. Two downwardly depending segments 20 fit into channels 30 and 31, respectively. The remaining two downwardly depending segments 20 fit into one of the deck openings 42 between boards of the pallet 32. In this manner, four stacks 40 can be placed and moved on full pallet 32.

Figure 5:
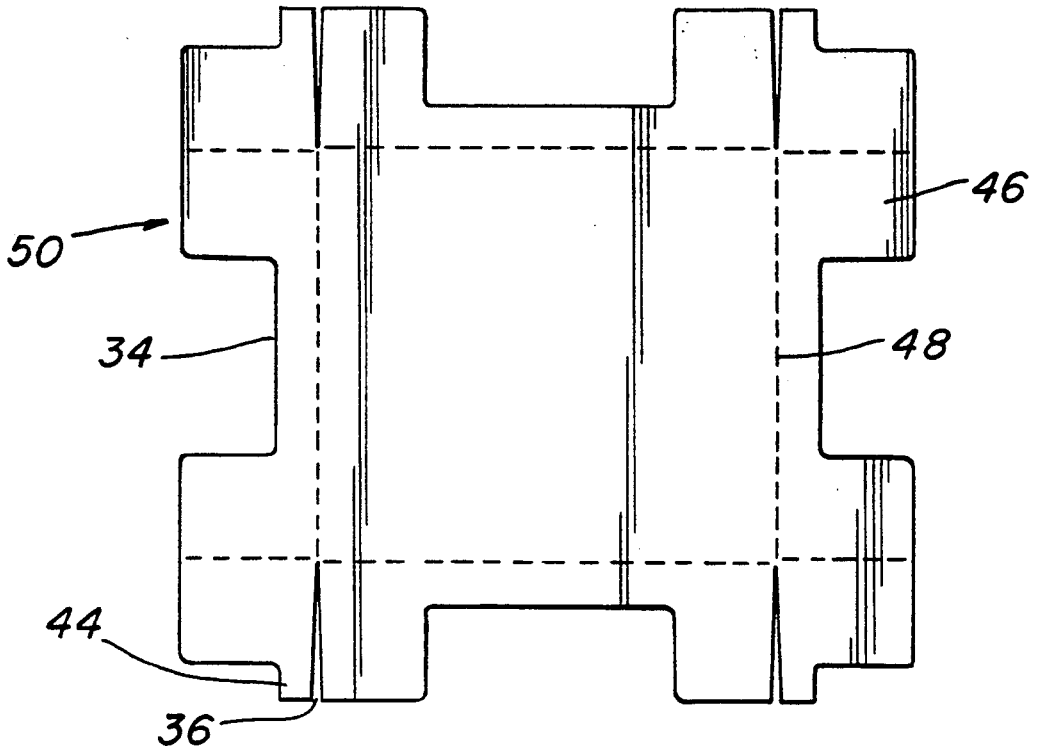
FIG. 5 is a top plan view of a blank for the container illustrated in FIG. 1.

FIG. 5 shows a plan view of a container blank 50 depicting the container 12 as it appears when laid flat. The blank 50 includes the container sides 13 and preferably includes cut-out portions 34. The container sides 13 are folded up along fold lines 48 to form the container 12. It is then placed in a frame 10. The cut-out region will allow access to the product without removing containers or racks disposed above the container to which access is desired. Cut-outs can be disposed on all four sides for maximum access. Alternatively, a cut-out can be made on only selected sides. The container 12, which is of the knockdown type, is also provided with relief cuts 36 on all four inside edges of corner fold sections 44. After the container 12 is folded together and placed in a frame 10, the relief cuts 36 allow each container to resist buckling due to the weight of the contents of containers disposed above. A more detailed description of this feature will be provided below with respect to FIG. 7. It should be noted that the corner fold sections 44 are not glued when the container 12 is folded together. In fact, no glue is used to hold any parts of the container 12 together in its folded state because the frame 10 prevents the sides from separating and unfolding. The omission of glue allows for easy and quick set-up and take-down and for material savings.

Figure 6:
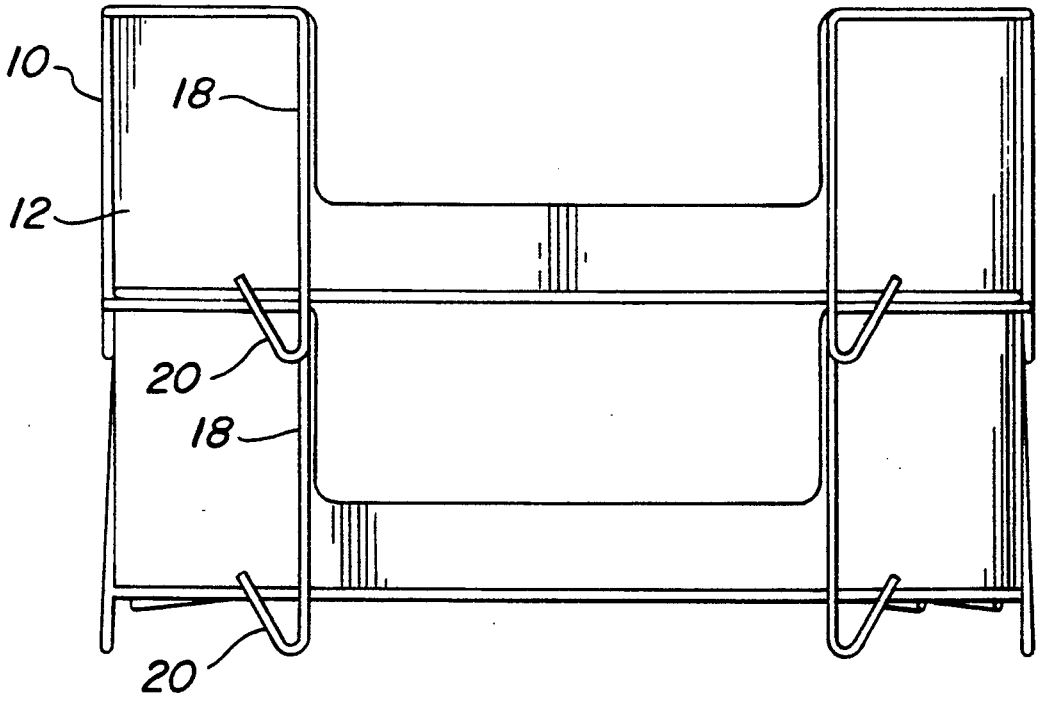
FIG. 6 is a side view showing two containers and supporting frames stacked one on top of the other.

FIG. 6 shows a side view of two identical containers 12 disposed in identical frames 10. The downwardly depending segments 20 of the upper frame 10 fit snugly over the outside surface of the container framing segments 18 of the lower frame 10. Slight flex afforded by the frame material allows for the container framing segments 18 of each vertically adjoining frame 10 to bend inward just enough so that the downwardly depending segment 20 can fit over it.

Figure 7:
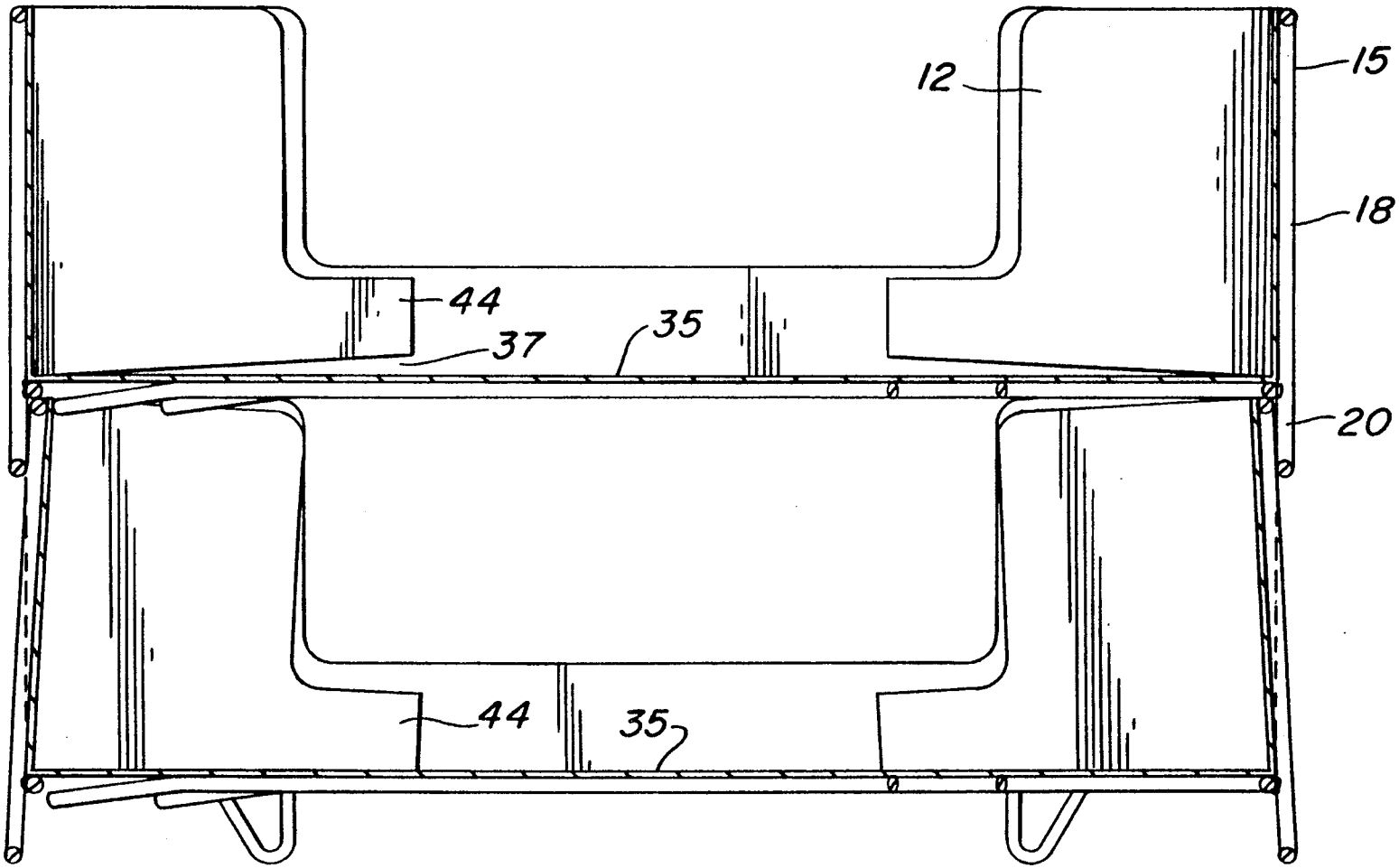
FIG. 7 is a sectional view of the container and frame combination taken along axis line 7—7 in FIG. 1.

FIG. 7 shows a sectional view of two identical containers 12 disposed in identical frames 10 and depicts the function of the relief cut 36. Since the upper container 12 does not have any weight placed on it from above, the inside corner fold section 44 forms angle 37 with the container bottom 35. Lower container 12, however, does have weight placed on it from upper container 12 and its frame 10. This weight causes the corner fold section 44 to tend to pivot downwardly, causing it to lay flat against the bottom 35 of the lower container 12. If no relief cut were made, the inside corner fold section 44 would more forcefully press down on the bottom 35 of the lower container 12, thereby significantly increasing forces on bottom 35 which would tend to cause the lower container 12 to buckle.

Figure 8:
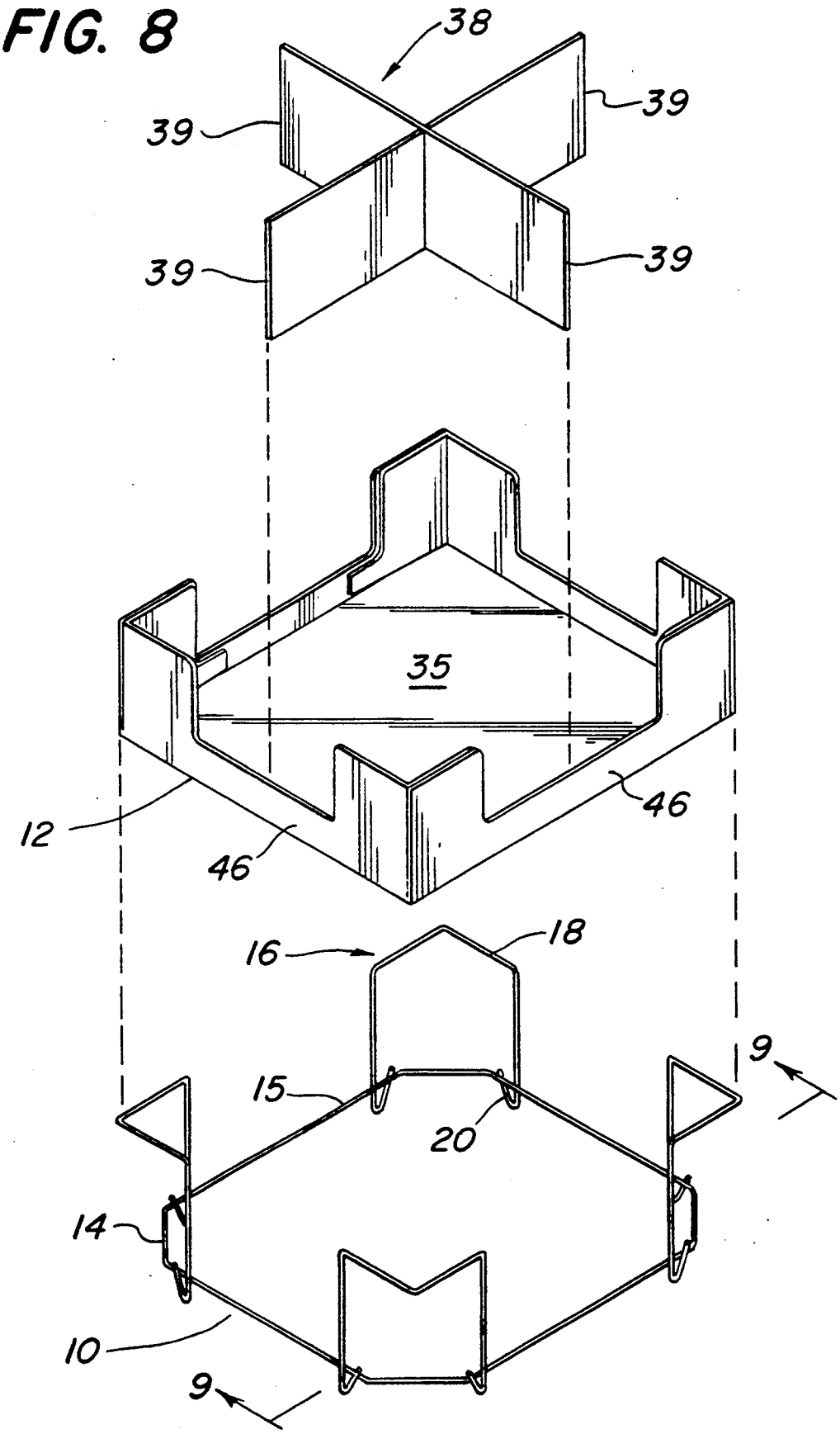
FIG. 8 is an exploded view of an alternate embodiment of the frame according to the invention, showing a container and a container framing segment.

FIG. 8 depicts yet another preferred embodiment of the frame and container combination. In this embodiment, a section divider 38 is inserted into the container 12 and rests on container bottom 35. Divider 38 has four arms 39, all at right angles to one another. The outer end of each arm 39 of divider 38 forms a perpendicular with one wall 46 of the container. The height of the section divider 38 is similar to the height of the frame's container framing segment 18. Section divider 38 has at least two advantageous uses. First, cross ties 22 and 23 depicted in FIG. 1 may be omitted since the section divider 38 performs the additional bracing function provided by the cross ties. If the divider 38 is constructed of corrugated board or paperboard, for example, as in the preferred embodiment, the substitution of the relatively inexpensive corrugated board support structure for the cross ties may provide a cost savings.

Second, the section divider 38 allows for easy product variation within the container. FIG. 8 shows an exemplary embodiment of a four way divider allowing for four different products to be placed in each container, separated from each other by the divider. It will be recognized that section divider 38 may alternatively be a two way divider running diagonally across the box. Other divider configurations are also possible, such as shown in FIG. 10 described below.

Figure 9:
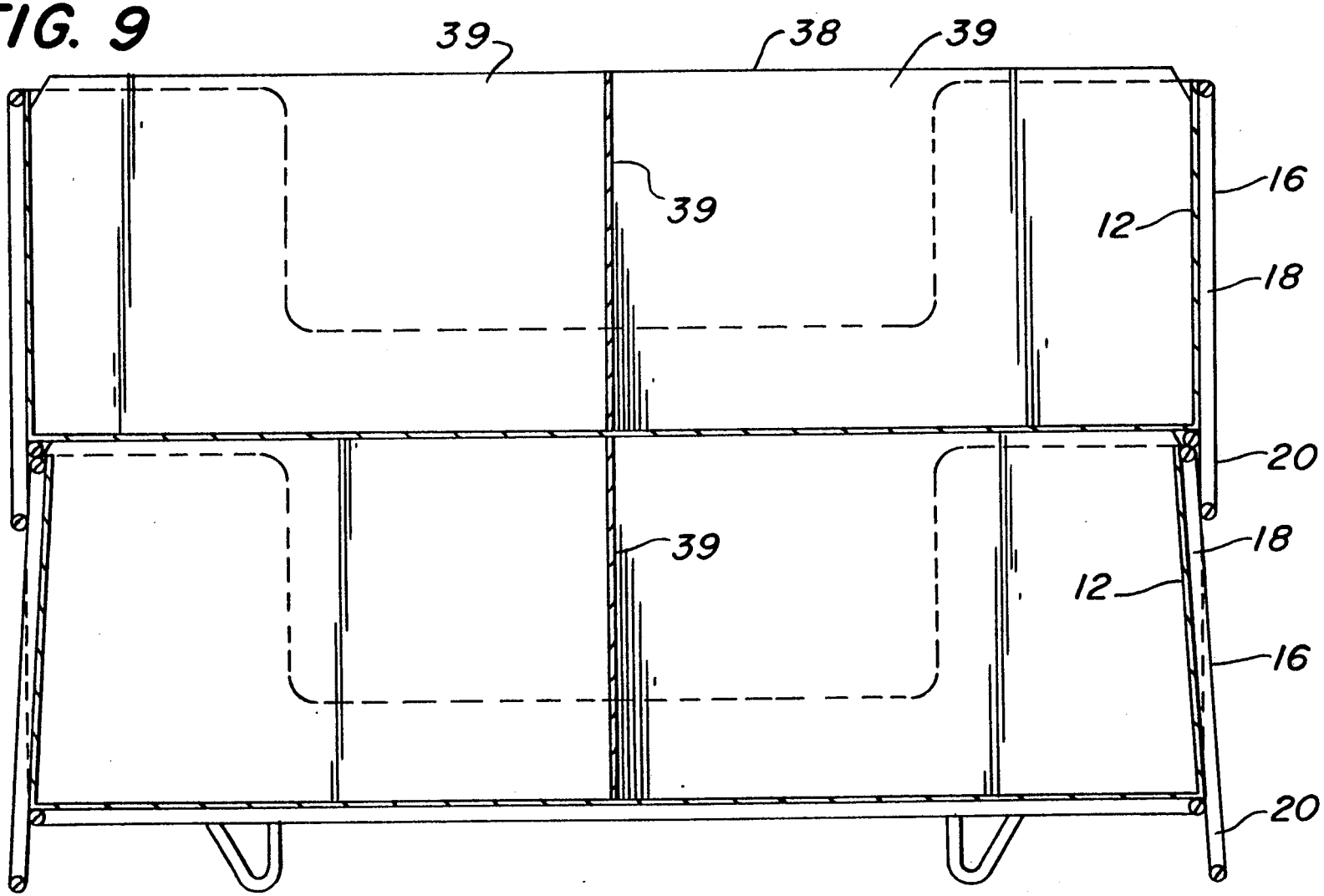
FIG. 9 is a sectional view taken along axis line 9—9 of FIG. 8.

FIG. 9 shows a sectional view taken along axis line 9—9 of FIG. 8. The section dividers 38 are disposed within the containers 12. This view more clearly depicts the slight flex afforded by the frame material which allows for the container framing segments 18 of each vertically adjoining frame to bend inward just enough so that the downwardly depending segment 20 can fit over it, as discussed above.

Figure 10:
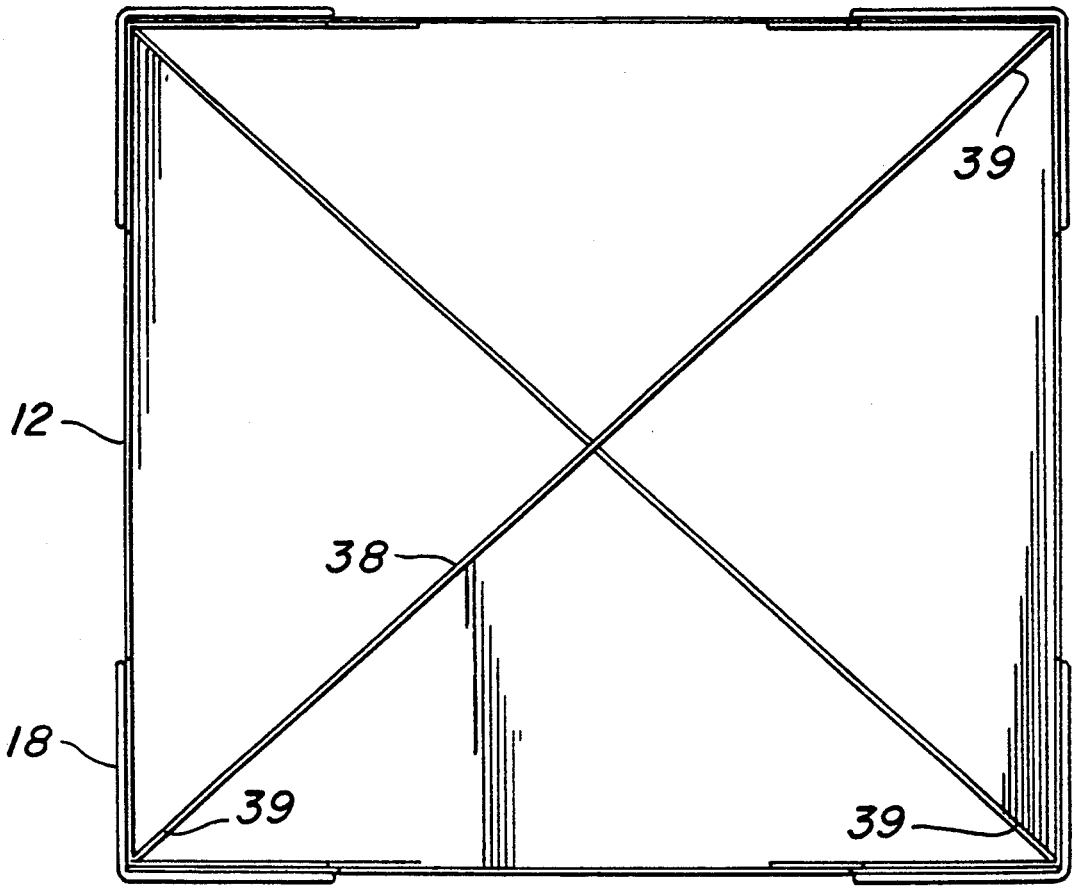
FIG. 10 is a top plan view of the container placed in a frame with an alternative embodiment of a container framing segment disposed therein.

FIG. 10 shows a top plan view of an alternative embodiment of the section divider 38 placed in the container 12 and creating four compartments. The outer ends of divider arms 39 fit into the corners of the container 12. This configuration allows for easy access to all four container compartments through the cut-outs 34.

In all of the preferred embodiments of the invention, the container 12 is of the knockdown type and preferably made from corrugated board or paperboard.

The frame 10 is preferably constructed of quarter-inch wire rod stock which is bent and tack welded. The rectangular section 15 is preferably constructed from a single piece of wire bent at an obtuse angle at each corner to form the container support sections 14. Each of the container framing segments 18 are also preferably constructed from a single piece of wire. The rectangular section 15 may also be a perfect rectangle with the container support sections 14 extending between adjacent sides of the rectangular portions and fastened thereto. Rod stock is advantageous because it is inexpensive and lightweight. Also, by forming the rod stock into a frame structure, the rod stock can be arranged to contact the container only at the edges, thereby allowing a maximum view of any graphics placed or printed on the outer face of the container when a stack is set up as a point-of-sale display. The frame structure also serves to space each corrugated board container a predetermined distance above another container. Frames constructed of quarter-inch wire rod stock with cross ties can support a stack of at least eight undivided containers, each holding 20–30 lbs., without damaging the container contents.

It should be understood that the frame 10 may be constructed of any material (e.g. plastic) which has the flexibility and strength properties suitable for the functions described above. Also, the frame 10 need not be constructed of single pieces of rod stock. Other manufacturing techniques are contemplated, especially when forming the corner sections. Furthermore, while tack welding is the preferred fastening method, any suitable fastening technique can be employed.

The container framing segments 18 of the corner sections 16 need not extend entirely above the plane defined by the rectangular section 15. These segments may extend partially above and partially below the plane. Additionally, the downwardly depending segments 20 of the corner sections 16 may be formed in the shape of the container framing segment 18. In such a configuration, the downwardly depending segments 20 would still snugly fit over the container framing segment 18 of the frame below it, thereby providing the same bracing and movement inhibiting functions of the preferred embodiment's downwardly depending segment 20.

The downwardly depending segment 20 of the frame 10 is preferably a loop-type shape, one such loop extending downward from both sides of the corner. The loop is tack welded at each end where it connects to the rectangular section 15.

However, the downwardly depending segment 20 need not necessarily have to take such a form. For example, it may consist of any straight or angled projection of frame material. In order to perform its function, it need only project downward and snugly fit over the container framing segment 18 of the frame below. The downwardly depending segments 20 can also serve as feet, thereby allowing the stack 40 or individual frames to be placed directly on a floor, instead of on a platform 24.

The present invention may be embodied in other specific forms without departing from the spirit or essential attributes thereof and, accordingly, reference should be made to the appended claims, rather than to the foregoing specification, as indicating the scope of the invention.

I claim:

1. A frame for providing exterior support for the body of a container, the frame comprising:

a substantially rectangular peripheral portion disposed in a plane; and corner members on at least two corners of the rectangular peripheral portion, each of the corner members having a framing member extending a predetermined distance from one side of the plane and at least two projecting members extending a predetermined distance from the opposite side of the plane, at least one projecting member disposed on each side of the corner members, each of the projecting members forming a loop, at least one end of each of the loops being rigidly fastened to the rectangular peripheral portion.

2. A frame as recited in claim 1, further comprising at least one angular corner segment for joining two adjacent sides of the rectangular peripheral portion.

3. A frame as recited in claim 2, wherein the substantially rectangular peripheral portion has at least one truncated corner, the angular corner segment forming the truncated corner.

4. A frame as recited in claim 1, wherein the rectangular peripheral portion and the corner members are fabricated from rod members.

5. A frame as recited in claim 4, wherein the rod members are wire rod.

6. A frame as recited in claim 1, wherein the rectangular peripheral portion is fabricated from a single rod member and wherein each corner member is fabricated from a single rod member.

7. A frame as recited in claim 1, further comprising at least one bracing member extending between diagonal corners of the rectangular peripheral portion.

8. A frame as recited in claim 1, wherein the corner members and the rectangular peripheral portion are fastened together at the points in which the corner members are planar with the rectangular peripheral portion.

9. A stackable display system for stacking a plurality of containers one on top of another, each container supported within a frame, the frame comprising:

a substantially rectangular peripheral portion disposed in a plane; and corner members on at least two corners of the rectangular peripheral portion, each of the corner members having a framing member extending a predetermined distance from one side of the plane and at least two projecting members extending a predetermined distance from the opposite side of the plane, at least one projecting member disposed on each side of the corner members, each projecting member bracing the frame of a container disposed below it by fitting over the outside of a framing member of the frame of the container below for inhibiting lateral movement of the frames with respect to each other, each of the projecting members forming a loop, at least one end of each of the loops being rigidly fastened to the rectangular peripheral portion.

10. A stackable display system as recited in claim 9, further comprising at least one angular corner segment for joining two adjacent sides of the rectangular peripheral portion.

11. A frame as recited in claim 10, wherein the substantially rectangular peripheral portion has at least one truncated corner, the angular corner segment forming the truncated corner.

12. A frame as recited in claim 9, wherein the rectangular peripheral portion and the corner members are fabricated from rod members.

13. A frame as recited in claim 12, wherein the rod members are wire rod.

14. A frame as recited in claim 9, wherein the rectangular peripheral portion is fabricated from a single rod member and wherein each corner member is fabricated from a single rod member.

15. A frame as recited in claim 9, further comprising at least one bracing member extending between diagonal corners of the rectangular peripheral portion.

16. A frame as recited in claim 9, wherein the corner members and the rectangular peripheral portion are fastened together at the points in which the corner members are planar with the rectangular peripheral portion.

17. A stackable display system for stacking a plurality of containers one on top of another, each container supported within a frame, the frame comprising:

a peripheral portion means for framing the outer edges of the frame, the peripheral portion means being substantially rectangular in shape and disposed in a plane; and corner means for framing and bracing the containers and frames, the corner means including framing means for framing the corners of one of the plurality of containers supported within a frame and preventing lateral movement of the container within the frame, the framing means extending a predetermined distance from one side of the plane, and projecting means for bracing the frame of a container disposed below it, the projecting means including at least two projecting members extending a predetermined distance from the opposite side of the plane, at least one projecting member disposed on each side of the corner means, each of the projecting members forming a loop, at least one end of each of the loops being rigidly fastened to the peripheral portion means, the loops fitting over the outside of the framing means of a frame of the container below for inhibiting lateral movement of the frames with respect to each other.

18. A stackable display system as recited in claim 17, further comprising at least one container support means for supporting the corners of the containers, the container support means joining two adjacent sides of the peripheral portion means.

19. A frame as recited in claim 18, wherein the peripheral portion means has at least one truncated corner, the container support means forming the truncated corner.

20. A frame as recited in claim 17, wherein the peripheral portion means and the corner means are fabricate from rod members.

21. A frame as recited in claim 20, wherein the rod members are wire rod.

22. A frame as recited in claim 17, wherein the peripheral portion means is fabricated from a single rod member and wherein each of the corner means is fabricated from a single rod member.

23. A frame as recited further in claim 17, further comprising at least one bracing means for strengthening the frame and further supporting the container placed therein, the bracing means extending between diagonal corners of the peripheral portion means.

24. A frame as recited in claim 17, wherein the corner means and the peripheral portion means are fastened together at the points in which the corner means are planar with the peripheral portion means.

25. In combination, a container and a frame for supporting the container, the frame comprising:

a substantially rectangular peripheral portion disposed in a plane;

corner members at each corner of the rectangular peripheral portion, each of the corner members having a framing member extending a predetermined distance from one side of the plane and at least two projecting members extending a predetermined distance from the opposite side of the plane, at least one projecting member disposed on each side of the corner members, each of the projecting members forming a loop, at least one end of each of the loops being rigidly fastened to the rectangular peripheral portion; and at least one angular corner segment for joining two adjacent sides of the rectangular peripheral portion and for supporting the container.

26. The combination as recited in claim 25, wherein the container includes a divider for forming plural sections, the height of the divider approximately equal to the height of the framing member, the dividers also providing cross-bracing for the container.

27. The combination as recited in claim 26, wherein the divider is constructed of corrugated board or paperboard.

28. The combination as recited in claim 23, wherein the container is constructed of corrugated board or paperboard.

29. The combination as recited in claim 23, wherein the container forms a generally open rectangular box and wherein a central portion of the sides are partially cut out for allowing access to contents of the containers.

30. The combination as recited in claim 23, wherein the container forms a generally open rectangular box and wherein an opening is cut out on at least one side section between corner sections for allowing access to contents of the containers.

31. A stackable display system for stacking a plurality of containers one on top of another, each container supported within a frame, the frame comprising:

a peripheral portion means for framing the outer edges of the frame, the peripheral portion means being substantially rectangular in shape and disposed in a plane;

corner means for framing and bracing the containers and frames, the corner means including framing means for framing the corners of one of the plurality of containers supported within a frame and preventing lateral movement of the container within the frame, the framing means extending a predetermined distance from one side of the plane, and projecting means for bracing the frame of a container disposed below it, the projecting means including at least two projecting members extending a predetermined distance from the opposite side of the plane, at least one projecting member disposed on each side of the corner means, each of the projecting members forming a loop, at least one end of each of the loops being rigidly fastened to the peripheral portion means, the loops fitting over the outside of the framing means of the frame of the container below for inhibiting lateral movement of the frames with respect to each other; and at least one container support means for supporting the corners of the containers, the container support means joining two adjacent sides of the peripheral portion means, the containers comprising corrugated board formed into a generally open rectangular box, the corners of the corrugated containers including relief means for giving relief from forces of containers disposed above each of the containers.

32. A stackable display system as recited in claim 31, wherein the containers are knockdown type containers.

33. A stackable display system as recited in claim 31, wherein the relief means comprises a relief cut formed along the bottom of each of the corner edges of the container.

34. A method for stacking a plurality of containers, each container supported within a frame, the frame comprising a peripheral portion means for framing the outer edges of the frame, the peripheral portion means being substantially rectangular in shape and disposed in a plane, corner means for framing and bracing the containers and frames, the corner means including framing means and projecting means, the framing means framing the corners of one of the plurality of containers supported within a frame and preventing lateral movement of the container within the frame, the framing means extending a predetermined distance from one side of the plane, the projecting means bracing the frame of a container disposed below it, the projecting means including at least two projecting members extending a predetermined distance from the opposite side of the plane, at least one projecting member disposed on each side of the corner means, each of the projecting members forming a loop, at least one end of each of the loops being rigidly fastened to the peripheral portion means, the loops fitting over the outside of the framing means of the frame of the container below for inhibiting lateral movement of the frames with respect to each other, and at least one container support means for supporting the corners of the containers, the container support means joining two adjacent sides of the peripheral portion means, the method comprising the steps of:

(a) placing a container in each of the frames, the bottom of each container supported by the container support means of its frame and the corners of each container flush against the framing means portion of its frame;

(b) stacking one frame on top of another so that the loops of the top frame fit over the outside of the framing means of the frame of a container disposed below it for bracing the lower frame and inhibiting lateral movement of the frames with respect to each other; and (c) repeating step (b) until all of the plurality of frames are stacked on top of each other.

35. A method for shipping an assembly comprising a plurality of stacked containers, each container supported within a frame, the frame comprising a peripheral portion means for framing the outer edges of the frame, the peripheral portion means being substantially rectangular in shape and disposed in a plane, corner means for framing and bracing the containers and frames, the corner means including framing means and projecting means, the framing means framing the corners of one of the plurality of containers supported within a frame and preventing lateral movement of the container within the frame, the framing means extending a predetermined distance from one side of the plane, the projecting means bracing the frame of a container disposed below it, the projecting means including at least two projecting members extending a predetermined distance from the opposite side of the plane, at least one projecting member disposed on each side of the corner means, each of the projecting members forming a loop, at least one end of each of the loops being rigidly fastened to the peripheral portion means, the loops fitting over the outside of the framing means of the frame of the container below for inhibiting lateral movement of the frames with respect to each other, and at least one container support means for supporting the corners of the containers, the container support means joining two adjacent sides of the peripheral portion means, the method comprising the steps of:

(a) placing a container in each of the frames, the bottom of each container supported by the container support means of its frame and the corners of each container flush against the framing means portion of its frame;

(b) stacking one frame on top of another so that the loops of the top frame fit over the outside of the framing means of the frame of a container disposed below it for bracing the lower frame and inhibiting lateral movement of the frames with respect to each other;

(c) repeating step (b) until all of the plurality of frames are stacked on top of each other, thereby forming a stacked assembly; and (d) placing a shroud over the entire stacked assembly.

36. A method as recited in claim 35, wherein the shroud comprises a corrugated board box fit over the assembly in a sleeve-like manner.

37. A method for stacking a plurality of containers, each container supported within a frame, the frame comprising a peripheral portion means for framing the outer edges of the frame, the peripheral portion means being substantially rectangular in shape and disposed in a plane, corner means for framing and bracing the containers and frames, the corner means including framing means and projecting means, the framing means framing the corners of one of the plurality of containers supported within a frame and preventing lateral movement of the container within the frame, the framing means extending a predetermined distance from one side of the plane, the projecting means bracing the frame of a container disposed below it, the projecting means including at least two projecting members extending a predetermined distance from the opposite side of the plane, at least one projecting member disposed on each side of the corner means, each of the projecting members forming a loop, at least one end of each of the loops being rigidly fastened to the peripheral portion means, the loops fitting over the outside of the framing means of the frame of the container below for inhibiting lateral movement of the frames with respect to each other, and at least one container support means for supporting the corners of the containers, the container support means joining two adjacent sides of the peripheral portion means, the method comprising the steps of:

(a) placing a container in each of the frames, the bottom of each container supported by the container support means of its frame and the corners of each container flush against the framing means portion of its frame;

(b) stacking one frame on top of another so that the loops of the top frame fit over the outside of the framing means of the frame of a container disposed below it for bracing the lower frame and inhibiting lateral movement of the frames with respect to each other;

(c) repeating step (b) until all of the plurality of frames are stacked on top of each other;

(d) placing the stack on a pallet.

38. A method as recited in claim 37, wherein the stack is placed on a full pallet having a plurality of parallel spaced top boards with open spacing between the boards and four slots perpendicularly disposed along a central portion of the pallet, the projecting means including two projecting members, each disposed on each side of the corner means, four adjacent projecting members of the bottom frame fitting over adjacent sides of the pallet, two adjacent projecting members fitting within one of the open spacings between the boards, and two adjacent projecting members fitted within two of the slots.

39. A method as recited in claim 37, wherein the stack is placed on a half pallet having a plurality of parallel spaced top boards with open spacing between the boards and two slots perpendicularly disposed along a central portion of the pallet, the projecting means including two projecting members, each disposed on each side of the corner means, six adjacent projecting members of the bottom frame fitting over adjacent sides of the pallet and two adjacent projecting members fitted within the slots.

40. A method as recited in claim 37, wherein the projecting means of the bottom frame fits over the outside of the pallet.

* * * * *